US005642578A

United States Patent [19]

Hazan et al.

[11] Patent Number: 5,642,578

[45] Date of Patent: Jul. 1, 1997

[54] FLAT-IRON COMPRISING A THERMAL DETECTOR WHICH MEASURES A FABRIC TEMPERATURE

[75] Inventors: Jean-Pierre Hazan, Sucy, France; Adriaan Netten, Singapore, Singapore; Jean-Louis Nagel, Limeil-Brevannes, France

[73] Assignee: U.S. Philips Corporation, New York, N.Y.

[21] Appl. No.: 579,652

[22] Filed: Dec. 27, 1995

[30] Foreign Application Priority Data

Dec. 29, 1994 [FR] France ..... 94 15871

[51] Int. Cl.[6] ..... D06F 75/26

[52] U.S. Cl. ..... 38/77.7; 38/93

[58] Field of Search ..... 38/74, 77.7, 93, 38/104, 137; 219/248, 250, 251, 252; 374/9, 208, 137

[56] References Cited

U.S. PATENT DOCUMENTS 4,360,277 11/1982 Daniel et al. ..... 374/137

FOREIGN PATENT DOCUMENTS 3023898 1/1991 Japan ..... 38/104

3267098 11/1991 Japan ..... 38/93

4005998 1/1992 Japan .

*Primary Examiner*—Ismael Izaguirre

*Attorney, Agent, or Firm*—Ernestine C. Bartlett

[57] ABSTRACT

A flat-iron (10) is provided which comprises a thermal detector (13) mounted at the soleplate (11) of the iron by a fixing device (14) having a structure which minimizes heat transfer between the detector and the soleplate of the iron. The fixing device (14) has a low heat capacity and provides the thermal insulation of the detector (13), which is pressed smoothly onto the fabric to measure its surface temperature. The fixing device includes low-effusivity materials (110).

The thermal detector (13) is used for controlling the operation of the iron (soleplate temperature, steam discharge).

26 Claims, 2 Drawing Sheets

FLAT-IRON COMPRISING A THERMAL DETECTOR WHICH MEASURES A FABRIC TEMPERATURE

FIELD OF THE INVENTION

The invention relates to a flat-iron comprising a soleplate to be moved over a fabric, heating means for heating the soleplate, a thermal detector for measuring a temperature of the fabric during ironing and for controlling the flat-iron, and fixing means for connecting the detector to the soleplate while thermally insulating it from the latter.

BACKGROUND OF THE INVENTION

Commercially available flat-irons measure the temperature of the soleplate and do not measure the temperature of the fabric itself. This is because it is difficult to measure a fabric temperature without this temperature being influenced to at least some extent by the soleplate temperature. Nevertheless, controlling the fabric temperature during ironing is a parameter which is important in order to obtain a good ironing quality.

The document JP 4-5998 describes a flat-iron comprising in particular a thermal detector for measuring the temperature of a fabric during ironing. The detector is disposed in the soleplate of the iron. In order to ensure that the detector is not influenced too strongly by the temperature of the soleplate of the iron, a thermal shielding is arranged around the detector. The document does not disclose the composition of the thermal shielding.

When a thermal detector which operates by contact with the fabric is placed on the fabric the temperature of the thermal detector should balance with that of the fabric. However, this balance may be disturbed by the high temperature of the soleplate, which gives rise to substantial thermal disturbances.

Moreover, the measurement of the fabric temperature should be carried out while the iron is moved over the fabric. Indeed, the iron cannot remain motionless at the risk of the fabric being burnt. Therefore, in order to control the parameters of the flat-iron, the response times of the detectors should be very small. The detector should therefore have a low thermal inertia without thereby becoming susceptible to thermal contributions of the soleplate. Therefore, the detector temperature should not be influenced too much by the soleplate temperature, both under dynamic and under static conditions.

In addition to these problems, which are related to heat transfer, there are several mechanical problems. First of all, there are problems as to the mechanical properties of the detector, which should be solved without the detector being adversely affected by repeated and considerable bending of the support which supports the detector. Secondly, there are mechanical problems in connection with the size. On the one hand, the detector should be mounted in the soleplate of a few millimeters thickness. On the other hand, the presence of the heating element, the supply of water, steam conduits, etc. does not leave much room to mount the detector and to solve the heat transfer problems.

Therefore, it is difficult to meet all these requirements at the same time, which partly explains why commercially available irons are not equipped with thermal detectors for the fabric.

SUMMARY OF THE INVENTION

It is an object of the invention to meet these requirements with the aid of special low-cost fixing means by which the thermal detector can be secured to the soleplate of the iron.

To this end the fixing means comprise a flexible cellular plate of low effusivity, the plate being intended to thermally insulate the detector from the soleplate and to press the detector flexibly against the fabric during ironing, the cellular plate being connected to the soleplate through a rigid thermally insulating support.

Thus, the fixing means are sufficiently rigid to preclude substantial bending of the detector, as a result of which any fatigue is avoided while the detector is applied correctly to the fabric so as to ensure a satisfactory thermal contact.

A low effusivity is characterized by a low thermal conductivity, a low specific mass and a low heat capacity.

At the end of a period in which the thermal detector disposed in the hot soleplate has not been in contact with the fabric it appears that the thermal detector assumes an equilibrium temperature closer to the temperature of the soleplate (generally above 100° C.) than the temperature of the fabric (generally close to the ambient temperature). At the instant at which ironing is started the detector temperature decreases very rapidly to the fabric temperature. According to the invention the time constant of the detector is approximately 0.1 to 0.4 seconds.

According to the invention the assembly comprising the thermal detector and the fixing means has the following advantages:

- owing to the low heat capacities and the low effusivity of the fixing means the assembly has a short response time and allows an adequate measurement of the fabric temperature in the useful temperature range for controlling a steam iron: typically starting at approximately 90° C. and higher,
- a very good thermal insulation between the thermal detector and the soleplate,
- a very good behavior of the thermal detector and the thermal insulation up to soleplate temperatures of approximately 200° C., which are the temperatures that can be measured at the soleplate of the iron. Thus, the fixing means ensure that the detector has a short response time and a low thermal inertia and a contact with low pressure owing to the flexible cellular plate. A rigid assembly is by means of the support, which ensures that a robust detector/fixing means assembly is obtained.

These characteristics are maintained even after a long ironing period because only a low accumulation of heat occurs in the cellular plate.

Preferably, the cellular plate is incorporated in the support to insulate the plate thermally and laterally from the soleplate and to improve its mechanical behavior. Thus, the fixing means provide a good lateral insulation to the detector parallel to the plane of the soleplate.

To protect the detector from wear effects and to ensure a satisfactory imperviousness to water vapor the detector is covered with a thin protective layer. This layer may cover the support at least partly to provide sealing between the detector and the support.

These and other aspects of the invention will become apparent from and elucidated on the basis of the embodiments described hereinafter.

BRIEF DESCRIPTION OF THE DRAWINGS

The invention will be more fully understood by means of the following drawings, which are given by way of non-limitative example and in which.

DESCRIPTION OF PREFERRED EMBODIMENTS

Figure 1:
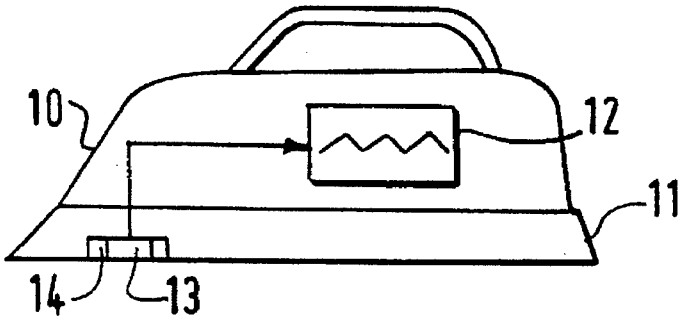
FIG. 1 shows diagrammatically a flat-iron with a thermal detector.

FIG. 1 shows a flat-iron 10 of a known type comprising a soleplate 11, heating means 12, a thermal detector 13 and fixing means 14, which secure the detector 13 to the soleplate 11 and provide thermal insulation between them. The thermal detector serves to control the heating means and/or the discharge of steam in the case of a steam iron.

Figure 2:
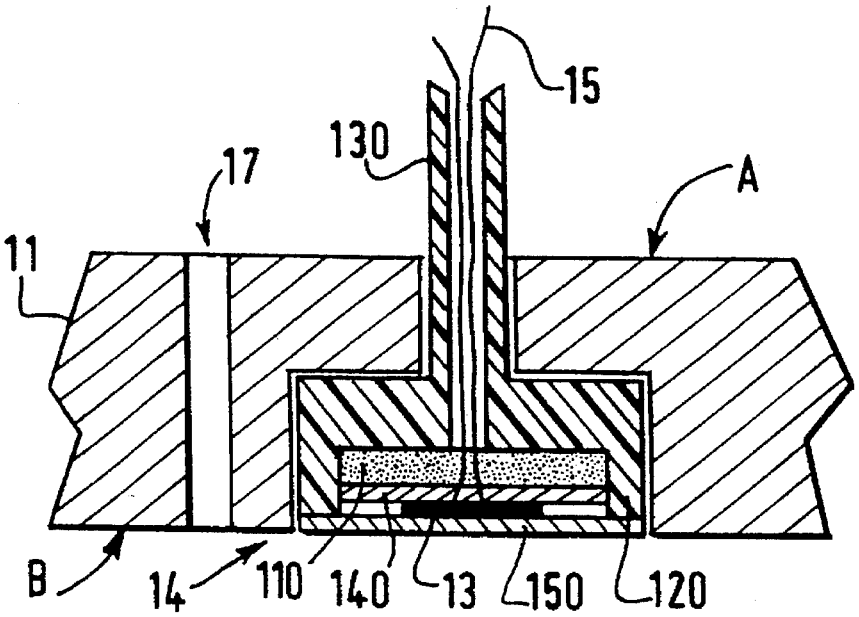
FIG. 2 shows diagrammatically a first variant of the fixing means of the thermal detector in accordance with the invention.

FIG. 2 shows the fixing means 14 of the detector 13 in accordance with the invention. By combining a cellular plate 110 with a support 120 the invention provides a solution to the following problems:

flexibility of the detector-fabric contact, thermal insulation of the detector, mechanical behavior and high-temperature behavior of the assembly, small size owing to the small thickness of the soleplate and the presence of the heating element, the supply of water, steam conduits, etc.

The cellular plate 110 is formed by a flexible and thermally insulating first material such as felt, having by nature a cellular, i.e. very open, structure, which provides both the required flexibility and the required thermal insulation. Felt has the advantage that it is a very good thermal insulator. The temperature of the felt may rise above 100° C. when the felt is not in contact with the fabric. Owing to its low heat capacity and its low effusivity it allows the detector to assume very rapidly a temperature close to that of the fabric. It is also possible to use other cellular materials, for example a silicone foam of very low density (approximately 0.1 to 0.2) or materials with a honeycomb structure such as the polyaramide material available commercially under the trademark "Nomex". These materials may be used separately or, preferably, in combination with a felt, which provides additional flexibility. Moreover, the felt prevents the detector from being damaged by direct contact with the honeycomb structure. The felt itself may be provided with an intermediate layer, for example a polyimide foil to prevent the honeycomb material from penetrating the felt. Commercially available felt materials may be used which can withstand temperatures up to approximately 250° C. and which have a very low density of the order of approximately 0.1 to 0.2.

When used alone a support based on felt does not have satisfactory mechanical properties to be mounted and secured separately to a soleplate of an iron without. the detector being damaged or during mounting or during use.

To overcome this problem the felt plate (of approximately a few millimeters thickness) is arranged on a support 120, which provides the necessary mechanical stiffness and additional satisfactory thermal insulation. This support is made of, for example, available "Teflon"*, which material is suitable for the range of temperatures usually occurring with irons.

One surface of the cellular plate 110 receives the detector 13, which is held in position, for example, by pressure or gluing. At its surface which faces the fabric the detector 13 is covered with a protective layer 150 of small thickness, for example of polyimide, to provide imperviousness and mechanical protection of the detector. To preclude a transfer of heat from the layer 150 to the sensitive element of the detector it is desirable that the distance between the sensitive element of the detector and the soleplate of the iron, parallel to the plane of the soleplate, is large enough to have a high temperature gradient, for example of the order of 50° C. to 80° C., between the thermal element and the soleplate. The other surface of the plate 110 is also held against the support 120 by pressure. A thin intermediate foil 140 may be interposed between the detector and the felt to prevent the detector from rubbing against the felt. Since the detector is generally disposed on a substrate, the latter may form either the protective layer 150 or the intermediate foil 140 depending on the orientation in which the detector is mounted. The support 120 has a tubular portion 130 to be passed through the soleplate 11. The tubular portion has a passage for guiding and insulating electrical connections 15 to the detector 13.

A surface B of the soleplate is in contact with the fabric. Another surface A of the soleplate is at least partly in contact with a supply of water (not shown), the water being turned into steam upon contact with the soleplate. During ironing the steam thus produced leaves the soleplate through apertures 17. The support 120 with its tubular portion 130 should be impervious to water vapor at the side of the surface A. This is achieved, for example, by introducing it with a driving fit into the soleplate and/or by gluing the support. The mechanical properties of the support thus serve to ensure a rigid and vapor tight fixation to the soleplate and to hold the plate in position.

Since the cellular plate is rather vulnerable it should not project from the side of the surface B. Therefore, in order to obtain a correct lateral thermal insulation, the plate is preferably incorporated in the support. The protective layer 150 is then extended so as to cover the transition between the plate and the support, in order to preclude the passage of moisture or steam.

The combination of the plate and the rigid support thus provides an optimum solution to the problems encountered when a thermal detector is to be connected to the soleplate of a flat-iron. This combination uses a cellular plate having a very low effusivity and a low heat capacity but not necessarily having good mechanical properties in conjunction with a support having very good mechanical properties but whose thermal insulation is not necessarily as good as that of felt and which, when used alone, would fail to meet the requirements.

In order to obtain reliable measurements of the temperature of the fabric it is desirable that the heat capacity of the fixing means is reduced to a minimum. This may result in the dimensions of the fixing means being reduced. It may then happen that the desired thickness for the support becomes so small that its mechanical properties are affected. This problem is solved by making the support of two parts: a first part whose major quality is its thermal insulation and a second part whose major quality is its mechanical rigidity. The material forming the second part is then selected to have a high rigidity even for small thicknesses.

Figure 3:
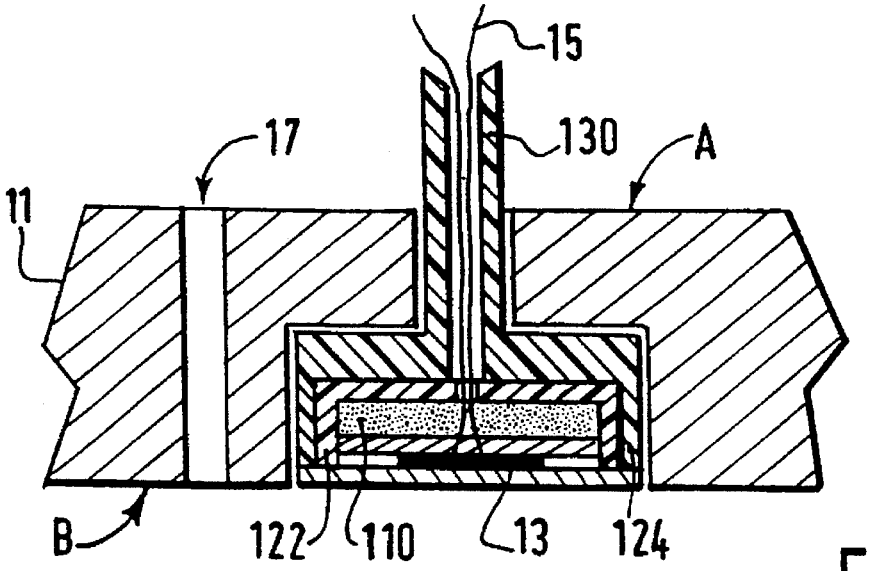
FIG. 3 shows diagrammatically a second variant of the fixing means of the thermal detector in accordance with the invention.

FIG. 3 shows such an embodiment. The support 120 is now made of two parts: an outer part 124, which is in contact with the soleplate and primarily chosen for its insulating properties though it is rigid, for example of Teflon, and an inner part 122, which is in contact with the plate 110 and which is primarily chosen for its rigidity, for example available commercially under the trademark Céléron. This last-mentioned material particularly has a very high rigidity even for a very small thickness and even after it has been at a high temperature for long periods. Its thermal insulating properties, however, are not as good as those of Teflon. Moreover, it is more suitable for affixing of the protective layer 150 by gluing. The complementarity of these two materials makes it possible to obtain a support having a satisfactory thermal insulation and an adequate mechanical rigidity even for a very small thickness, i.e. for a low heat capacity.

It is moreover possible to reduce the heat capacity of the fixing means in order to reduce the response time of the detector and to obtain a more accurate measurement of the fabric temperature by providing recesses in the single-part support (FIG. 2) or in the two-part support (FIG. 3), so as to reduce the contact surfaces between the elements for the purpose of reducing the heat transfer.

Figure 4:
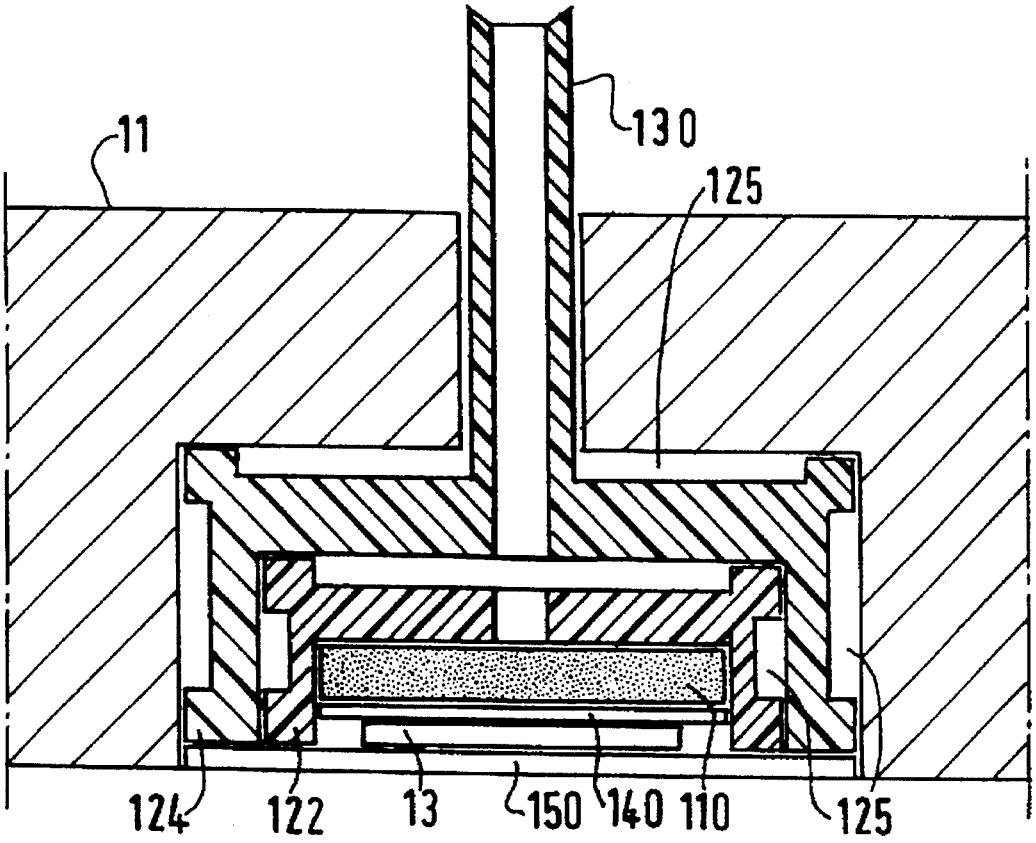
FIG. 4 shows diagrammatically a special exemplary embodiment corresponding to the second variant.

FIG. 4 shows an embodiment comprising a two-part support. The outer part 124 and the inner part 122 have recesses 125 formed in each of the parts at their peripheries. This reduces heat transfer between the outer part 124 and the inner part 122 and heat transfer between the outer part 124 and the soleplate 11. It is also possible to provide recesses at the inside of the outer part 124. Other methods of reducing the contact areas are conceivable to the expert. In order to reduce heating by radiation from the soleplate the surfaces of the supports 124 and 122, particularly the surfaces facing the soleplate, can be made reflecting. This can be effected by applying a coating which reflects in the infrared (aluminium, gold), for example, by vapor deposition.

Figure 5:
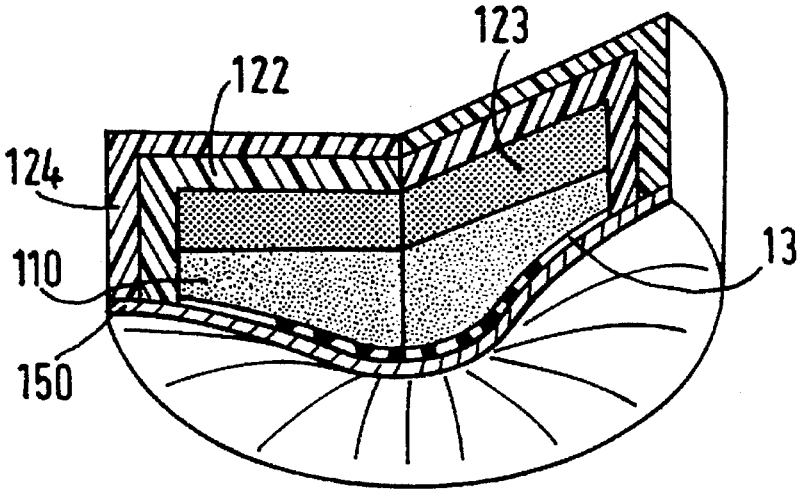
FIG. 5 is a perspective sectional view of a detector arranged in fixing means which give the detector a slightly convex outer shape.

Although this is not apparent from FIG. 4, it is to be noted that the protective layer 150 extends slightly beyond the outer surface of the soleplate 11. This arrangement serves to ensure that during ironing the detector 13 can be applied to the fabric by means of the protective layer 150. This contact with the fabric can be promoted by giving the plate 110 a slightly curved shape, for example in its, center. This is the case in a special embodiment shown diagrammatically in FIG. 5, which is a perspective sectional view of the fixing means. The fixing means have a generally cylindrical shape with a circular base. The outer part 124 of the support has a cup shape (inverted in FIG. 5) filled with another cup 122 of Céléron, which itself is filled with a honeycomb material 123 forming the inner part. The felt 110 is disposed on the material 123. Preferably, a thin polyimide foil is interposed between the felt and the part of a honeycomb material to preclude damage to the felt plate 110. This felt is slightly compressed by the pressure exerted by the protective layer 150 glued to the outer part 124. In its center the felt has a curved shape, in order to obtain an elasticity effect. Fixed to this felt are a thin intermediate foil 140 (FIG. 4) (not shown in FIG. 5 but it may be the substrate of the detector), the thermal detector 13 and the protective layer 150. Thus, when the iron is moved over the fabric the detector will remain in constant thermal contact despite surface irregularities of the fabric, thereby enabling a reliable measurement of the fabric temperature to be obtained.

In order to obtain an adequate measurement of the fabric temperature and a short response time the detector should have a low heat capacity. The detector may be a surface temperature detector comprising a sensitive element such as a resistive coating deposited, for example, on a substrate formed by a thin sheet of polyimide by a thick-film or thin-film technique, or a resistive coating which is affixed, for example, by gluing. It may also comprise a sensitive element such as surface thermocouples formed by, for example, thin or thick films deposited by suitable techniques. The thin film to be used should be capable of handling, without being deformed, temperatures of the order of 100° C. and even higher caused by heating by the soleplate. The thin film should have such a low heat capacity that the temperature measurement is not disturbed. Thin polyimide or Teflon foils having a thickness of 20 to 100 micrometres are suitable for this purpose.

We claim:

1. A operation of the flat-iron comprising a soleplate (11) to be moved over a fabric, heating means (12) for heating the soleplate, a thermal detector (13) for measuring a temperature of the fabric during ironing and for controlling the flat-iron, fixing means (14) for connecting the detector to the soleplate while thermally insulating it from the soleplate, wherein the fixing means comprise a flexible cellular plate (110) of low effusivity, the cellular plate being effective to thermally insulate the detector from the soleplate and to press the detector flexibly against the fabric during ironing, the cellular plate being connected to the soleplate through a rigid thermally insulating support (120).

2. A flat-iron as claimed in claim 1, wherein the cellular plate is selected from a member of the group of: a felt plate, a low-density silicone foam, a honeycomb plate, and a felt/honeycomb combination.

3. A flat-iron as claimed in claim 2 wherein the cellular plate is incorporated in the support to insulate the plate thermally from the soleplate.

4. A flat-iron as claimed in claim 2, wherein the support has limited contact surfaces in order to reduce heat transfer with the soleplate.

5. A flat-iron as claimed in claim 2, wherein the detector has a protective layer (150) of small thickness to provide imperviousness and mechanical protection of the detector.

6. A flat-iron as claimed in claim 2 wherein the cellular plate gives the detector a shape which is slightly convex.

7. A flat-iron as claimed in claim 2 wherein the thermal detector has a low heat capacity, the thermal detector comprising either resistive sensitive elements on a thin support or sensitive elements formed by surface thermocouples.

8. A flat-iron as claimed in claim 1 wherein the cellular plate is incorporated in the support to insulate the plate from the soleplate.

9. A flat-iron as claimed in claim 8, wherein the support has limited contact surfaces in order to reduce heat transfer with the soleplate.

10. A flat-iron as claimed in claims 8, wherein the detector has a protective layer (150) of small thickness to provide imperviousness and mechanical protection of the detector.

11. A flat-iron as claimed in claim 8 wherein the cellular plate gives the detector a shape which is slightly convex.

12. A flat-iron as claimed in claim 8 wherein the thermal detector has a low heat capacity, the thermal detector comprising either resistive sensitive elements on a thin support or sensitive elements formed by surface thermocouples.

13. A flat-iron as claimed in any claim 1, characterised in the support has limited contact surfaces in order to reduce heat transfer with the soleplate.

14. A flat-iron as claimed in claim 13, wherein the detector has a protective layer (150) of small thickness to provide imperviousness and mechanical protection of the detector.

15. A flat-iron as claimed in claim 13 wherein the cellular plate gives the detector a shape which is slightly convex.

16. A flat-iron as claimed in claim 13 wherein the thermal detector has a low heat capacity, the thermal detector comprising either resistive sensitive elements on a thin support or sensitive elements formed by surface thermocouples.

17. A flat-iron as claimed in claim 13, wherein the support comprises two parts (122, 124) formed of materials of different rigidity.

18. A flat-iron as claimed in claim 17, wherein the detector has a protective layer (150) of small thickness to provide imperviousness and mechanical protection of the detector.

19. A flat-iron as claimed in claim 17 wherein the cellular plate gives the detector a shape which is slightly convex.

20. A flat-iron as claimed in claim 19 wherein the thermal detector has a low heat capacity, the thermal detector comprising either resistive sensitive elements on a thin support or sensitive elements formed by surface thermocouples.

21. A flat-iron as claimed in claim 1 wherein, characterised in the detector has a protective layer (150) to provide imperviousness and mechanical protection of the detector.

22. A flat-iron as claimed in claim 21 wherein the cellular plate gives the detector a shape which is slightly convex.

23. A flat-iron as claimed in claim 21 wherein the thermal detector has a low heat capacity, the thermal detector comprising either resistive sensitive elements on a thin support or sensitive elements formed by surface thermocouples.

24. A flat-iron as claimed in claim 1 wherein the cellular plate gives the detector a shape which is slightly convex.

25. A flat-iron as claimed in claim 24 wherein the thermal detector has a low heat capacity, the thermal detector comprising either resistive sensitive elements on a thin support or sensitive elements formed by surface thermocouples.

26. A flat-iron as claimed in claim 1 wherein the thermal detector has a low heat capacity, the thermal detector comprising either resistive sensitive elements on a thin support or sensitive elements formed by surface thermocouples.

* * * * *